United States Patent [19]

Butler

[11] 4,120,052

[45] Oct. 17, 1978

[54] CUSHIONED PROTECTOR

[75] Inventor: Carl D. Butler, Blanch, N.C.

[73] Assignee: Royal Textile Mills, Inc., Yanceyville, N.C.

[21] Appl. No.: 841,343

[22] Filed: Oct. 12, 1977

[51] Int. Cl.[2] ..... A41D 13/08

[52] U.S. Cl. ..... 2/16; 2/24; 2/DIG. 6

[58] Field of Search ..... 2/16, 20, 21, 22, 24, 2/62, 59, DIG. 6

[56] References Cited

U.S. PATENT DOCUMENTS

| | | | |
|---|---|---|---|
| 1,627,497 | 5/1927 | Gamino | 2/24 |
| 2,552,177 | 5/1951 | Hurt | 2/24 |
| 2,759,189 | 8/1956 | Cole | 2/24 |
| 3,066,306 | 12/1962 | Thomas | 2/20 |
| 3,189,919 | 6/1965 | Chase | 2/16 |
| 3,322,873 | 5/1967 | Hitchcock | 2/24 X |
| 3,648,291 | 3/1972 | Pankers | 2/16 |
| 4,011,596 | 3/1977 | Chang | 2/16 |
| 4,041,940 | 8/1977 | Frankel et al. | 2/24 X |
| 4,071,913 | 2/1978 | Rector | 2/20 |

*Primary Examiner*—Werner H. Schroeder
*Assistant Examiner*—Moshe I. Cohen
*Attorney, Agent, or Firm*—Bell, Seltzer, Park & Gibson

[57] ABSTRACT

The cushioned protector aids in preventing injury to the knees and/or elbows of the wearer and includes a stretchable sleeve of textile material which is easily drawn over and resiliently engages and covers the elbow or knee of the wearer. A cushioning pad is carried by the sleeve and a protective plastic panel covers the cushioning pad. Adjustable elastic straps are provided adjacent opposite ends of the protector to encircle the protector and aid in preventing slipping of the sleeve on the limb of the wearer.

4 Claims, 6 Drawing Figures

CUSHIONED PROTECTOR

This invention relates generally to a cushioned protector for aiding in preventing injury to the knees or elbows of the wearer and more particularly to a cushioned protector to be used by participants in various types of sports activities, such as skateboard riders.

Cushioned protectors for the knees and elbows have been known for many years and usually include a tubular stretchable inner sleeve, a cushioning pad covering at least a portion of the sleeve, and an outer cover over the cushioning pad for maintaining the same in position on the sleeve. Cushioning protectors of this known type are illustrated in U.S. Pat. Nos. 2,552,177 and 3,189,919.

Cushioned protectors of this type have been used by participants in various types of sports activities and are most widely used by basketball players. This type of cushioned protector is suited for use by basketball players because the game is played on a highly polished floor and when the elbow or knee of the wearer engages the polished floor, the cushioned protector remains in position and very little if any damage is imparted to the cushioned protector.

However, this type of cushioned protector is not suited for use by skateboard riders because this activity is usually carried out on relatively rough concrete and when the elbow or knee engages this surface, the fabric outer layer is damaged by the concrete. Also the rough concrete causes the cushioned protector to slide off the knee or elbow so that the knee or elbow slides along the concrete, causing the skin to be scraped and torn.

With the foregoing in mind, it is an object of the present invention to provide a cushioned protector which includes adjustable strap means secured adjacent opposite ends of the protector for aiding in preventing slippage of the protector on the limb of the wearer, and with a protective plastic panel to permit the protector to slide on a rough surface while protecting the protector from damage by the rough surface.

The cushioned protector of the present invention includes an elongate sleeve of textile material having sufficient stretchability to be easily drawn over and resiliently engage and cover the knee or elbow of the wearer. A cushioning pad is carried by the sleeve and is adapted to cover and protect the knee or elbow of the wearer. A protective plastic panel extends longitudinally of the sleeve and covers at least the major portion of the cushioning pad. The plastic panel permits the protector to slide along a rough surface and protects the textile material from damage by the rough surface. Adjustable strap means is provided adjacent opposite ends of the protector for encircling the protector to aid in preventing the slipping of the sleeve on the limb of the wearer when the protector slides along a rough surface.

The sleeve is formed of seamless weft knit fabric with elastic yarn inlaid therein to provide substantial circumferential stretchability and very limited longitudinal stretchability. A pocket for supporting the cushioning pad is provided on the sleeve by a textile panel which is formed of weft knit fabric. The textile panel is seamed at opposite sides and opposite ends to the sleeve so that the cushioning pad is retained in the pocket. The protective plastic panel includes a textile material facing inwardly of the protector and a plastic film material laminated to the textile material and facing outwardly of the protector. The plastic panel is sewn directly to the textile panel forming the pocket for the cushioning pad. The adjustable strap means includes a pair of elastic tapes with one end of each of the elastic types being fixed to the protective plastic panel and the other end of each of the elastic tapes including one element of a separable fastener, such as VELCRO. The other element of the VELCRO separable fastener is fixed on the protective plastic pad for releasably securing the elastic tapes in position encircling opposite ends of the protector.

Other objects and advantages will appear as the description proceeds when taken in connection with the accompanying drawings, in which FIG. 1 is a perspective view of a skateboard rider illustrating the cushioned protector of the present invention in position on both elbows and both knees;

Figure 4:
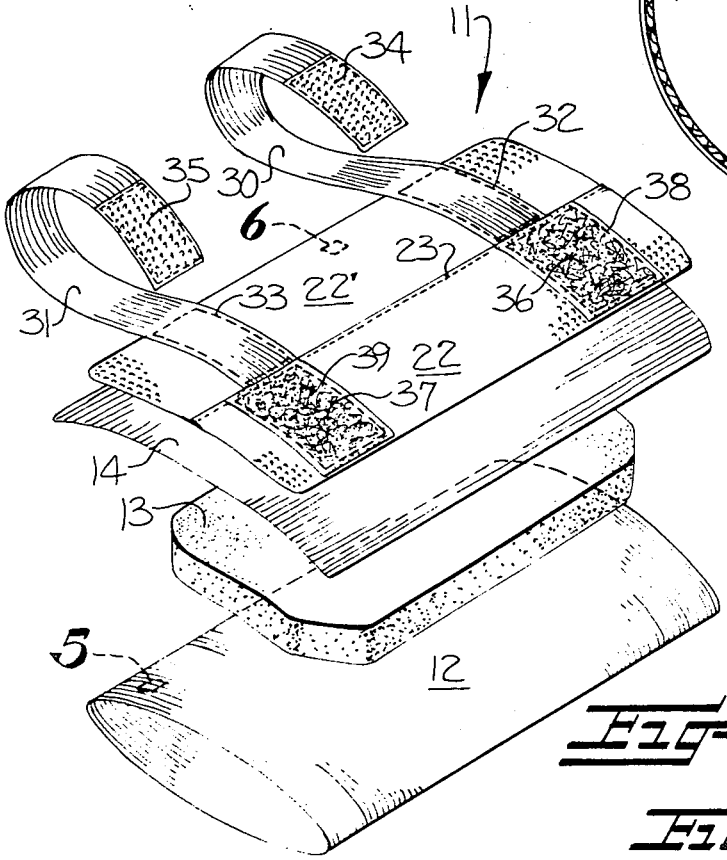
FIG. 4 is an exploded isometric view of the cushioned protector illustrating the individual elements which form the protector.
Figure 5:
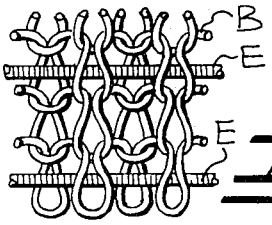
Figure 6:
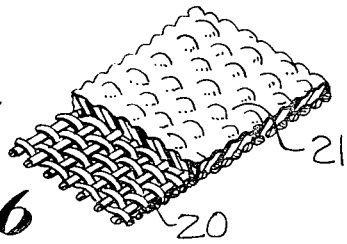

FIG. 5 is an enlarged elevational view illustrating the type of stitch loop construction employed in knitting the sleeve of the protector, being taken in the rectangle 5 in FIG. 4; and FIG. 6 is a greatly enlarged isometric view of a small area of the protective plastic panel illustrating the manner in which the plastic film is laminated to the textile material, being taken in the rectangle 6 in FIG. 4.

Figure 1:
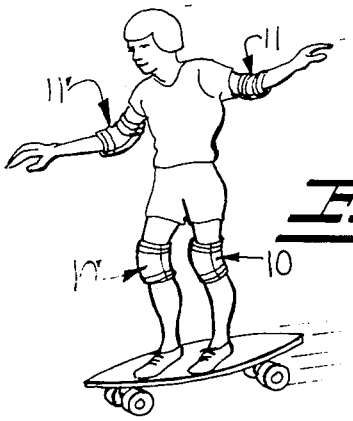
Figure 2:
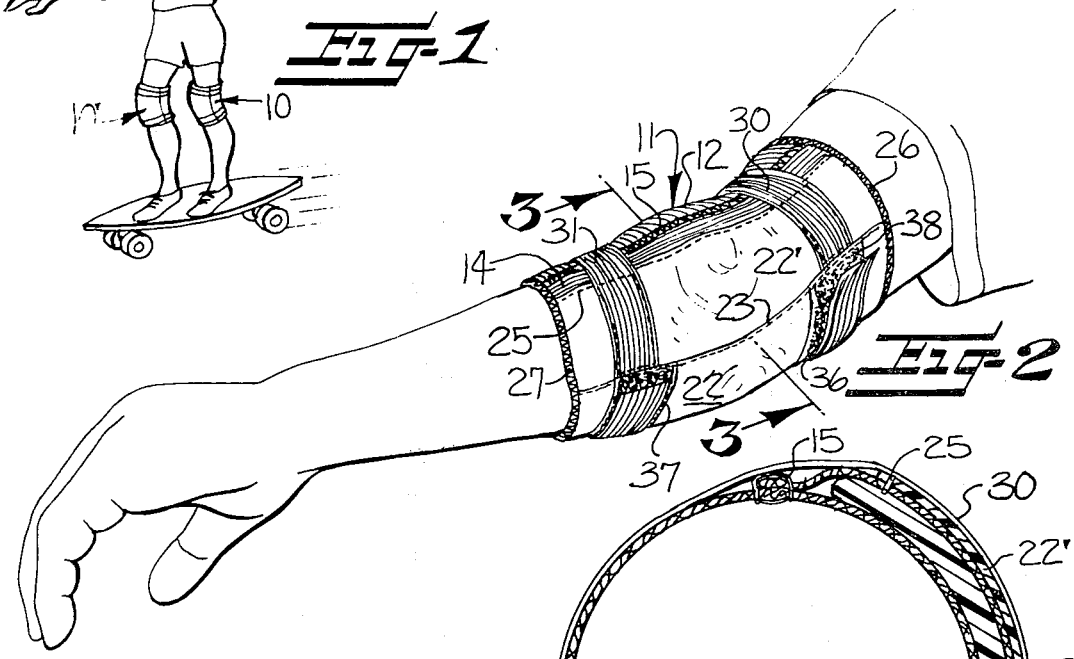
FIG. 2 is an enlarged perspective view of the cushioned protector of the present invention in position on the elbow of a wearer.
Figure 3:
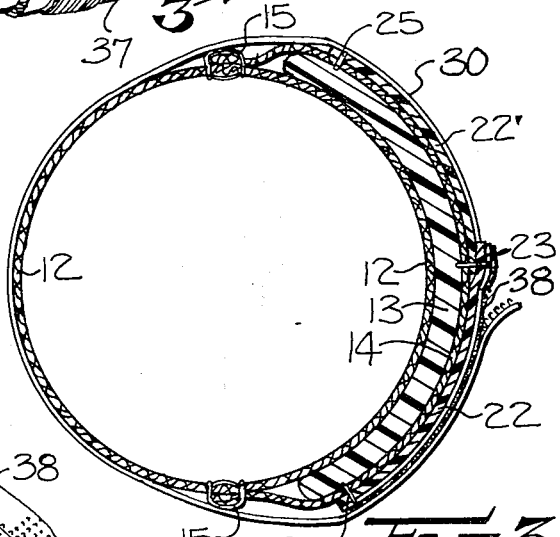
FIG. 3 is an enlarged vertical sectional view through the cushioned protector, being taken substantially along the line 3—3 in FIG. 2.

The skateboard rider shown in FIG. 1 is illustrated with a pair of cushioned protectors, illustrated broadly at 10 and 10', positioned on the knees, and a pair of cushioned protectors, illustrated broadly at 11 and 11', on the elbows. Both the knee protectors 10 and the elbow protectors 11 include the same parts with the knee protectors 10 being larger in diameter and slightly longer than the elbow protectors 11. Therefore, only the elbow protector, broadly indicated at 11 in FIGS. 2–6, will be described in detail.

The cushioned protector 11 includes an elongate sleeve of textile material, indicated at 12 in FIG. 4, having sufficient stretchability to be easily drawn over and resiliently engage and cover the elbow of the wearer. The sleeve 12 is formed of seamless weft knit fabric and is illustrated in FIG. 5 as being what is known as a one-by-one rib fabric which is knit with a body yarn B forming successive courses of stitch loops with the stitch loops in alternate wales facing outwardly and the stitch loops in intervening wales facing inwardly. An elastic yarn E is inlaid in alternate courses of the fabric so that the elastic yarn alternately passes in front of and behind adjacent stitch loops to provide substantial circumferential stretchability and very limited longitudinal stretchability.

A cushioning pad 13 is cut to the desired shape from any suitable type of foam rubber or the like and is adapted to cover and protect the elbow of the wearer. The cushioning pad 13 is held in position by a pocket which is formed by a textile panel 14 of weft knit fabric. The textile panel 14 forming the pocket for the cushioning pad 13 is of the same length as the sleeve 12 and has a width substantially one half the circumference of the sleeve. Suitable overedge seams 15 connect opposite sides of the panel 14 to the sleeve 12 to retain the cushioning pan 13 in the proper circumferential position on the sleeve 12.

Protective plastic panel means extends longitudinally of the sleeve 12 and covers at least the major portion of the cushioning pad 13. The protective plastic panel means includes a woven textile material, indicated at 20 in FIG. 6, which faces inwardly of the protector and a plastic film material, indicated at 21, which is laminated to the outer surface of the textile material 20 and may be provided with an embossed or dimpled outer surface to reduce the coefficient of friction of the outer surface of the protective plastic panel means when it slides along a rough surface.

As illustrated in FIG. 4, the plastic protective plastic panel means includes a pair of side-by-side slide panels 22 and 22' with the medial portions being overlapped and seamed together along a line of stitching 23. The stitching 23 penetrates the textile panel 14 and attaches the medial portion of the plastic panel to the textile panel 14. Lines of stitching, indicated at 24 and 25 in FIG. 3, extend along opposite side edges of the panels 22, 22' to secure the opposite side edges to the textile panel 14. Overedge stitching 26 and 27 is provided at opposite ends of the sleeve 12 (FIG. 2) to attach opposite ends of the panels 22, 22' and 14 to opposite ends of the sleeve 12 and retain the cushioning pad 13 in position longitudinally of the sleeve 12. An elastic band may be incorporated in the overedge seams 26, 27.

Adjustable strap means is secured adjacent opposite ends of the protector for encircling the protector to aid in preventing the slipping of the sleeve on the limb of the wearer. To this end, one end of a pair of woven elastic tapes 30, 31 is secured to the plastic panel 22' as by respective stitching 32, 33. One element of a separable fastener, illustrated as the hooked elements 34, 35 of a VELCRO fastener, is stitched to the other ends of the elastic tapes 30, 31. The second element of the VELCRO fastener, illustrated in FIG. 4 as the pile elements 36, 37, is stitched to the panel 22, as by respective stitching 38 and 39.

To position the cushioned protector on the limb of the wearer, the stretchable sleeve 12 is drawn up on the limb with the protective plastic panels 22, 22' covering the area of the elbow or knee which is most likely to engage the surface should the wearer fall. The elastic tapes 30, 31 are stretched around opposite end portions of the protector and the hooked elements 34, 35 are attached to the pile elements 36, 37 to hold the elastic tapes 30, 31 in position to aid in preventing slippage of the sleeve on the limb of the wearer.

If the skateboard rider should fall on the relatively rough concrete surface, the protective plastic panels 22, 22' will engage the surface and prevent damage to the knit fabric and also permit the protector to slide along the surface. The elastic tapes 30 and 31 also aid in holding the protector in position on the limb so that the cushioned protector will not slip and expose the knee or elbow to injury by the rough surface.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. A cushioned protector for aiding in preventing injury to the knee or elbow of the wearer and comprising (a) an elongate sleeve of textile material having sufficient stretchability to be easily drawn over and resiliently engage and cover the knee or elbow of the wearer, (b) a cushioning pad carried by said sleeve and adapted to cover and protect the knee or elbow of the wearer, (c) flexible protective panel means extending longitudinally of said sleeve and covering at least the major portion of said cushioning pad, said panel means permitting said sleeve to slide along a rough surface and protecting the textile material from damage by said rough surface, and (d) adjustable strap means secured adjacent opposite ends of said protector and encircling said protector, said adjustable strap means comprising a pair of elastic tapes, one end of each of said elastic tapes being secured to said protective panel means, the other end of each of said elastic tapes including one element of a separable fastener secured thereto, and including a second element of said separable fastener fixed on said protective panel for releasably connecting said one element of said separable fasteners thereto, said elastic tapes increasing the resilient engagement of opposite ends of said protector to aid in preventing the slipping of said sleeve on the knee or elbow of the wearer.

2. A cushioned protector according to claim 1 wherein said sleeve comprises seamless weft knit fabric with elastic yarn inlaid therein to provide substantial circumferential stretchability and very limited longitudinal stretchability.

3. A cushioned protector according to claim 1 including a pocket in which said cushioning pad is supported and wherein said pocket comprises a panel of weft knit fabric of the same length as said sleeve and having a width substantially one-half the circumference of said sleeve, and including seam means connecting opposite sides and opposite ends of said knit panel to the outer surface of said sleeve with said cushioning pad being retained between said sleeve and said panel of weft knit fabric.

4. A cushioned protector according to claim 1 wherein said flexible protective panel means includes a textile material facing inwardly of said protector, and a plastic film material laminated to said textile material and facing outwardly of said protector.

* * * * *